US010802427B2

(12) United States Patent
Adachi et al.

(10) Patent No.: US 10,802,427 B2
(45) Date of Patent: Oct. 13, 2020

(54) HEATING DEVICE FOR FIXING DEVICE OF IMAGE FORMING APPARATUS HAVING PLURALITY OF RESISTANCE HEATING ELEMENTS AND POWER INTERRUPTER

(71) Applicants: Tomoya Adachi, Kanagawa (JP); Yuusuke Furuichi, Kanagawa (JP); Yukimichi Someya, Saitama (JP)

(72) Inventors: Tomoya Adachi, Kanagawa (JP); Yuusuke Furuichi, Kanagawa (JP); Yukimichi Someya, Saitama (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 16/232,246

(22) Filed: Dec. 26, 2018

(65) Prior Publication Data

US 2019/0196374 A1 Jun. 27, 2019

(30) Foreign Application Priority Data

Dec. 26, 2017 (JP) ..... 2017-249230
Dec. 19, 2018 (JP) ..... 2018-237465

(51) Int. Cl.
*G03G 15/20* (2006.01)
*H05B 3/00* (2006.01)
(Continued)

(52) U.S. Cl.
CPC ..... *G03G 15/2039* (2013.01); *G03G 15/2042* (2013.01); *H05B 1/0213* (2013.01);
(Continued)

(58) Field of Classification Search
CPC ..... G03G 15/2039; G03G 15/2042; G03G 15/5004; H05B 1/0213; H05B 3/0066;
(Continued)

(56) References Cited

U.S. PATENT DOCUMENTS 7,027,749 B2 * 4/2006 Kamei ..... G03G 15/2042 399/330
7,193,181 B2 * 3/2007 Makihira ..... G03G 15/2042 219/216
(Continued)

FOREIGN PATENT DOCUMENTS

EP 2711778 A2 3/2014
EP 3495893 A1 6/2019
(Continued)

OTHER PUBLICATIONS

Extended European Search report dated Oct. 21, 2019 for European Patent Application No. 18215082.1.

*Primary Examiner* — Robert B Beatty
(74) *Attorney, Agent, or Firm* — Harness, Dickey & Pierce P.L.C.

(57) ABSTRACT

A heating device includes a base, resistance heating elements, a power control circuit, a first temperature detector, a second temperature detector, a power interrupter, and control circuitry. The resistance heating elements are arranged in a longitudinal direction of the base and electrically connected in parallel. The first detector detects a temperature of a first resistance heating element. The second detector detects a temperature of a second resistance heating element. The power interrupter interrupts power supplied to the resistance heating elements when the temperature of the second resistance heating element becomes a predetermined temperature or more. The control circuitry controls the circuit such that a temperature of each resistance heating element becomes a predetermined temperature, based on a result of detection of the first detector, and interrupts the power supplied to the resistance heating elements when the second detector detects predetermined temperature information regarding the second resistance heating element.

38 Claims, 12 Drawing Sheets

(51) Int. Cl.
*H05B 1/02* (2006.01)
*H05B 3/26* (2006.01)

(52) U.S. Cl.
CPC ..... *H05B 3/0066* (2013.01); *H05B 3/26* (2013.01); *H05B 2203/005* (2013.01); *H05B 2203/035* (2013.01)

(58) Field of Classification Search
CPC .... H05B 3/26; H05B 3/265; H05B 2203/005; H05B 2203/02; H05B 2203/035
USPC ..... 399/33, 69, 330, 334; 219/216, 483, 510
See application file for complete search history.

(56) References Cited

U.S. PATENT DOCUMENTS 8,391,761 B2 * 3/2013 Mitsuoka ..... G03G 15/2039 219/216
9,829,839 B2 * 11/2017 Ando ..... G03G 15/2046
2009/0245900 A1 10/2009 Kagawa
2010/0303525 A1 12/2010 Mitsuoka et al.
2019/0179242 A1 * 6/2019 Adachi ..... G03G 15/2039

FOREIGN PATENT DOCUMENTS

JP 11233243 A * 8/1999
JP 2000131977 A * 5/2000
JP 2001242740 A 9/2001
JP 2008139778 A * 6/2008
JP 2015-148778 8/2015
JP 2015-194713 11/2015
JP 2015-227917 12/2015
JP 2016-018127 2/2016
JP 2016-153859 8/2016
WO WO-2017/043020 A1 3/2017

* cited by examiner

HEATING DEVICE FOR FIXING DEVICE OF IMAGE FORMING APPARATUS HAVING PLURALITY OF RESISTANCE HEATING ELEMENTS AND POWER INTERRUPTER

CROSS-REFERENCE TO RELATED APPLICATION

This patent application is based on and claims priority pursuant to 35 U.S.C. § 119(a) to Japanese Patent Application Nos. 2017-249230, filed on Dec. 26, 2017, and 2018-237465, filed on Dec. 19, 2018, in the Japan Patent Office, the entire disclosure of each of which is incorporated by reference herein.

BACKGROUND

Technical Field

The present disclosure relates to a heating device including a plurality of resistance heating elements, a fixing device, and an image forming apparatus.

Related Art

Various types of fixing devices to be used in electrophotographic image forming apparatuses, have been known. One type of fixing device heats a thin fixing belt having low heat capacity, with a planar heating body including a base and a resistance heating element.

SUMMARY

A heating device includes a base; a plurality of resistance heating elements arranged in a longitudinal direction of the base and electrically connected in parallel to each other; a power control circuit configured to supply power to the plurality of resistance heating elements; a first temperature detector configured to detect a temperature of a first resistance heating element of the plurality of resistance heating elements; a second temperature detector configured to detect a temperature of a second resistance heating element of the plurality of resistance heating elements; a power interrupter configured to interrupt the power supplied from the power control circuit to the plurality of resistance heating elements when the temperature of the second resistance heating element becomes a predetermined temperature or more; and control circuitry configured to control the power control circuit such that a temperature of each of the plurality of resistance heating elements becomes a predetermined temperature, based on a result of detection of the first temperature detector. The control circuitry is configured to interrupt the power supplied from the power control circuit to the plurality of resistance heating elements when the second temperature detector detects predetermined temperature information regarding the second resistance heating element.

BRIEF DESCRIPTION OF THE DRAWINGS

The aforementioned and other aspects, features, and advantages of the present disclosure would be better understood by reference to the following detailed description when considered in connection with the accompanying drawings, wherein:

FIGS. 3G to 31 are plan views each illustrating the disposition of resistance heating elements in a meandering pattern including electrodes provided at both ends;

FIG. 4 is a diagram of a heating device, a power control circuit, and a controller;

Figure 1A:
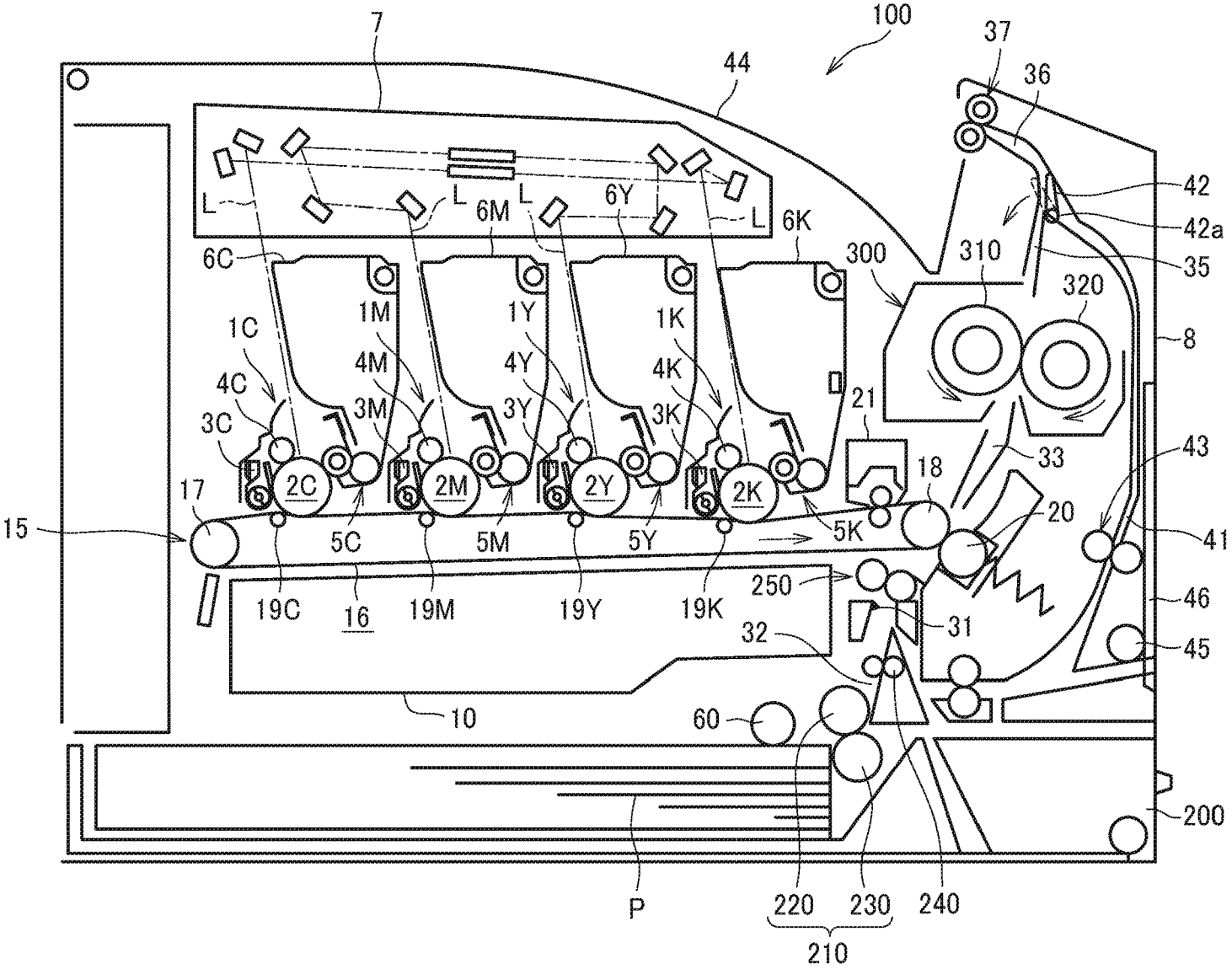
FIG. 1A is a schematic view of the configuration of an image forming apparatus according to an embodiment of the present disclosure.

The accompanying drawings are intended to depict embodiments of the present disclosure and should not be interpreted to limit the scope thereof. The accompanying drawings are not to be considered as drawn to scale unless explicitly noted.

DETAILED DESCRIPTION OF EMBODIMENTS

In describing embodiments illustrated in the drawings, specific terminology is employed for the sake of clarity. However, the disclosure of this patent specification is not intended to be limited to the specific terminology so selected and it is to be understood that each specific element includes all technical equivalents that operate in a similar manner and achieve similar results.

Although the embodiments are described with technical limitations with reference to the attached drawings, such description is not intended to limit the scope of the disclosure and all of the components or elements described in the embodiments of this disclosure are not necessarily indispensable.

Referring now to the drawings, embodiments of the present disclosure are described below. In the drawings for explaining the following embodiments, the same reference codes are allocated to elements (members or components) having the same function or shape and redundant descriptions thereof are omitted below.

A heating device according to an embodiment of the present disclosure, a fixing device using the heating device, and an image forming apparatus (laser printer) will be described below with reference to the drawings. Note that the same parts or similar parts are denoted with the same reference signs in the figures, and thus the duplicate descriptions of the parts will be simplified or omitted appropriately. The dimensions, material, shape, and relative position in a description for each constituent component are exemplary. Unless otherwise specifically described, the scope of the present disclosure is not limited to those.

Although a "recording medium" will be described as a "sheet" in the following embodiment, the "recording medium" is not limited to paper (sheet). Examples of the "recording medium" include not only paper (sheet) but also an overhead projector (OHP) sheet, a fabric, a metallic sheet, a plastic film, and a prepreg sheet including carbon fibers previously impregnated with resin.

Examples of the "recording medium" include a medium to which developer or ink can adhere, and so-called recording paper and recording sheets. Examples of the "sheet" include thick paper, a postcard, an envelope, thin paper, coated paper (e.g., coat paper and art paper), and tracing paper, in addition to plain paper.

"Image formation" to be used in the following descriptions means not only giving an image having a meaning, such as a character or a figure, to a medium but also giving an image having no meaning, such as a pattern, to a medium.

Configuration of Laser Printer

Figure 1B:
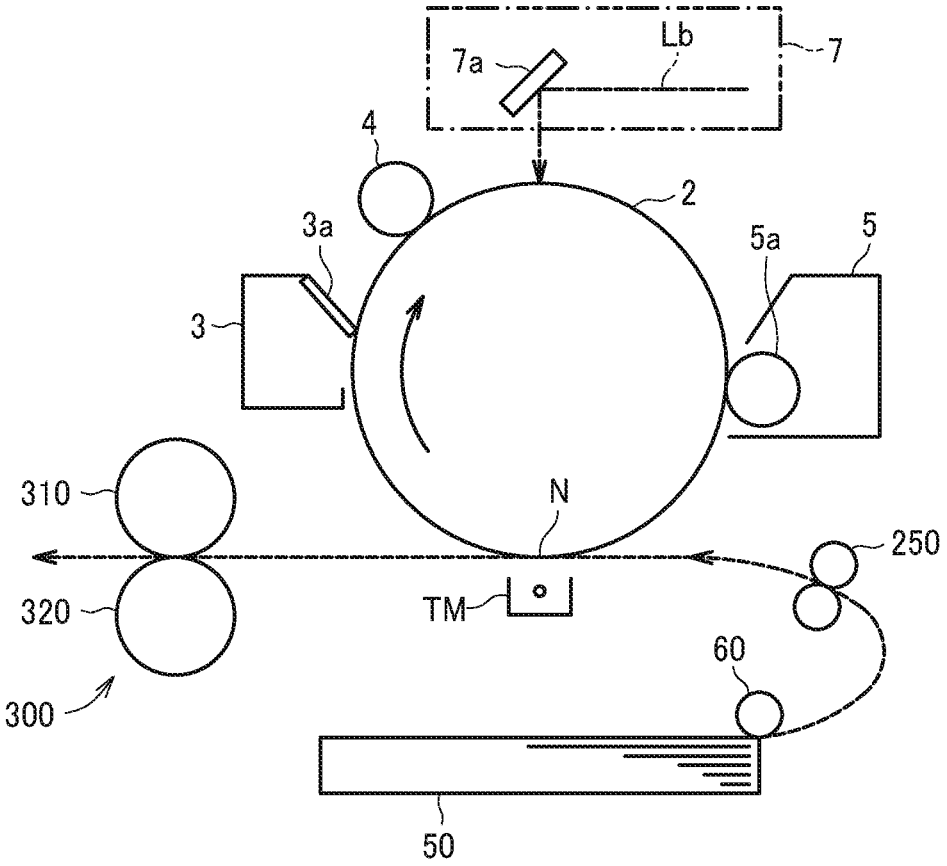
FIG. 1B is a principle view of the image forming apparatus according to the embodiment of the present disclosure.

FIG. 1A is a schematic view of the configuration of a color laser printer 100 that is an image forming apparatus including a heating device 3000 and a fixing device 300, according to one embodiment of the present disclosure. FIG. 1B simplifies and illustrates the principle of the laser printer 100.

The color laser printer 100 includes four process units 1K, 1Y, 1M, and 1C each serving as an image forming unit. The process units form an image with respective developers of black (K), yellow (Y), magenta (M), and cyan (C) in color corresponding to the color separation components of a color image.

The process units 1K, 1Y, 1M, and 1C have similar configurations except including toner bottles 6K, 6Y, 6M, and 6C housing unused toners in mutually different colors. Thus, the configuration of the one process unit 1K will be described below, and the descriptions of the other process units 1Y, 1M, and 1C will be omitted.

The process unit 1K includes an image bearer 2K (e.g., a photoconductor drum), a drum cleaning device 3K, and a discharging device. The process unit 1K further includes a charging device 4K serving as a charging unit that uniformly charges the surface of an image bearer and a developing device 5K serving as a developing unit that performs visible image processing to an electrostatic latent image on the image bearer. The process unit 1K is detachably attached to the body of the laser printer 100 and thus can be replaced simultaneously with a consumed component.

An exposure device 7 is arranged above the process units 1K, 1Y, 1M, and 1C provided in the laser printer 100. The exposure device 7 performs writing scanning in accordance with image information, namely, causes a mirror 7*a* to reflect a laser beam Lb from a laser diode to irradiate the image bearer 2K with the laser beam Lb, on the basis of image data.

A transfer device 15 is arranged below the process units 1K, 1Y, 1M, and 1C in the present embodiment. The transfer device 15 corresponds to a transfer unit TM of FIG. 1B. Primary transfer rollers 19K, 19Y, 19M, and 19C are disposed opposed to the image bearers 2K, 2Y, 2M, and 2C, respectively, abutting on an intermediate transfer belt 16.

The intermediate transfer belt 16 that has been kept taut around the primary transfer rollers 19K, 19Y, 19M, and 19C, a driving roller 18, and a driven roller 17, circulates and travels. A secondary transfer roller 20 is disposed opposed to the driving roller 18, abutting on the intermediate transfer belt 16. Note that if the image bearers 2K, 2Y, 2M, and 2C are regarded as first image bearers for the colors, the intermediate transfer belt 16 is a second image bearer on which the respective images on the image bearers 2K, 2Y, 2M, and 2C are combined.

A belt cleaning device 21 is provided on the downstream side with respect to the secondary transfer roller 20 in the traveling direction of the intermediate transfer belt 16. A cleaning backup roller is provided on the opposite side of the belt cleaning device 21 with respect to the intermediate transfer belt 16.

A sheet feeding device 200 including a tray loaded with sheets P, is provided below the laser printer 100. The sheet feeding device 200 intended for a recording-medium supply device, can house a sheaf of a large number of sheets P each serving as a recording medium. The sheet feeding device 200 is unitized together with a sheet feeding roller 60 and paired rollers 210 serving as a conveyor for the sheets P. The sheet feeding device 200 is detachably inserted in the body of the laser printer 100 for sheet supply. The sheet feeding roller 60 and the paired rollers 210 disposed above the sheet feeding device 200, convey the uppermost sheet P in the sheet feeding device 200 to a sheet feed path 32.

Paired registration rollers 250 that serve as a separation conveyor and are disposed on the nearest upstream side in the conveyance direction of the secondary transfer roller 20, can temporarily stop the sheet P fed from the sheet feeding device 200. The temporary stop causes slack on the front end side of the sheet P, so that the oblique (skew) of the sheet P is modified.

A registration sensor 31 arranged on the nearest upstream side in the conveyance direction of the paired registration rollers 250, detects the passage of the front end portion of a sheet. When a predetermined time passes after the registration sensor 31 detects the passage of the front end portion of the sheet, the sheet is thrust against the paired registration rollers 250 to stop temporarily.

A conveyance roller 240 for conveying the sheet conveyed on the right side from the paired rollers 210, upward, is arranged at the downstream end of the sheet feeding device 200. As illustrated in FIG. 1A, the conveyance roller 240 conveys the sheet to the paired registration rollers 250 above.

The paired rollers 210 include a pair of an upper roller and a lower roller. The paired rollers 210 can adopt a friction reverse roller (FRR) separation system or a friction roller (FR) separation system. The FRR separation system presses a separation roller (return roller) to which a driving shaft has applied a certain amount of torque in the counter sheet feeding direction through a torque limiter, against a feed roller to separate a sheet with the nip between the rollers. The FR separation system presses a separation roller (friction roller) supported by a secured shaft against a feed roller through a torque limiter to separate a sheet with the nip between the rollers.

The paired rollers 210 in the present embodiment adopt the FRR separation system. That is the paired rollers 210 include an upside feed roller 220 that conveys a sheet inside the machine and a downside separation roller 230 that gives a driving force in the reverse direction of the upside feed roller 220 with a driving shaft through a torque limiter.

The separation roller 230 is biased to the feed roller 220 by a biasing means, such as a spring. Note that transmission of the driving force of the feed roller 220 through a clutch, rotates the sheet feeding roller 60 left in FIG. 1A.

The sheet P having the slack at the front end portion due to the thrust against the paired registration rollers 250, is sent out to the secondary transfer nip between the secondary transfer roller 20 and the driving roller 18 (transfer nip N in FIG. 1B) at a suitable timing of transferring the toner image on the intermediate transfer belt 16. The sent-out sheet P has the toner image on the intermediate transfer belt 16, electrostatically transferred at a desirable transfer position with high accuracy by a bias applied at the secondary transfer nip.

A post-transfer conveyance path 33 is arranged above the secondary transfer nip between the secondary transfer roller 20 and the driving roller 18. The fixing device 300 is provided in proximity to the upper end of the post-transfer conveyance path 33. The fixing device 300 includes: a fixing belt 310 enveloping the heating device 3000; and a pressing roller 320 serving as a pressing member that rotates while abutting on the fixing belt 310 with a predetermined pressure. Note that other configurations as in FIGS. 2B to 2D to be described later can be adopted as the fixing device 300.

A post-fixing conveyance path 35 arranged above the fixing device 300, branches into a sheet ejection path 36 and a reverse conveyance path 41 at the upper end of the post-fixing conveyance path 35. A switching member 42 disposed at the branch, pivots on the pivot shaft 42*a* of the switching member 42. Paired ejection rollers 37 are arranged in proximity to the opening end of a sheet ejection path 36.

The reverse conveyance path 41 joins together with the sheet feed path 32, at the other end on the opposed side to the branch. Paired reverse conveyance rollers 43 are arranged midway through the reverse conveyance path 41. An ejection tray 44 having a recess in the inward direction of the laser printer 100, is provided at the upper portion of the laser printer 100.

A powder container 10 (e.g., a toner container) is disposed between the transfer device 15 and the sheet feeding device 200. The powder container 10 is detachably attached to the body of the laser printer 100.

From the viewpoint of transfer-paper conveyance, the laser printer 100 according to the present embodiment, needs a predetermined distance from the sheet feeding roller 60 to the secondary transfer roller 20. The powder container 10 is provided in dead space due to the distance, so that the entire laser printer is rendered in miniaturization.

A transfer cover 8 is disposed on the front side in the drawing direction of the sheet feeding device 200 above the sheet feeding device 200. Opening the transfer cover 8 enables an internal inspection of the laser printer 100. The transfer cover 8 includes a manual sheet feeding roller 45 for manual sheet feeding and a manual sheet feeding tray 46 for manual sheet feeding.

Note that the laser printer according to the present embodiment is an exemplary image forming apparatus, and thus the image forming apparatus is not limited to the laser printer. That is the image forming apparatus can include any one of a copying machine, a facsimile, a printer, a printing machine, and an inkjet recording device or can include a multifunction peripheral having a combination of at least two of the copying machine, the facsimile, the printer, the printing machine, and the inkjet recording device.

Operation of Laser Printer

Next, the fundamental operation of the laser printer according to the present embodiment will be described below with reference to FIG. 1A. First, a case where single-sided printing is performed, will be described. As illustrated in FIG. 1A, the sheet feeding roller 60 rotates due to a sheet feeding signal from a controller of the laser printer 100. The sheet feeding roller 60 separates the uppermost sheet from a sheaf of sheets P loaded in the sheet feeding device 200, and sends the uppermost sheet out to the sheet feed path 32.

The sheet P sent out by the sheet feeding roller 60 and the paired rollers 210 has slack when the front end of the sheet P arrives at the nip between the paired registration rollers 250, and then remains on standby. An optimum timing of transferring the toner image on the intermediate transfer belt 16 to the sheet P (synchronization) is determined and additionally the front end skew of the sheet P is corrected.

For manual sheet feeding, a sheaf of sheets loaded in the manual sheet feeding tray 46 one by one from the uppermost sheet passes through part of the reverse conveyance path 41 due to the manual sheet feeding roller 45, and then is conveyed to the nip between the paired registration rollers 250. The following operation is the same as the sheet feeding from the sheet feeding device 200.

The image forming operation of the one process unit 1K will be described, and the descriptions of the image formation operations of the other process units 1Y, 1M, and 1C will be omitted. First, the charging device 4K charges the surface of the image bearer 2K uniformly at high potential. The exposure device 7 irradiates the surface of the image bearer 2K with the laser beam Lb on the basis of the image data.

The surface of the image bearer 2K irradiated with the laser beam Lb, has an electrostatic latent image due to a drop in the potential of the irradiated portion. The developing device 5K including a developer carrier carrying a developer including toner, transfers unused black toner supplied from the toner bottle 6K to the surface portion of the image bearer 2K having the electrostatic latent image, through the developer carrier. The image bearer 2K to which the toner has been transferred, forms (develops) a black toner image on the surface of the image bearer 2K. The toner image on the image bearer 2K is transferred to the intermediate transfer belt 16.

The drum cleaning device 3K removes the remaining toner adhering to the surface of the image bearer 2K after the intermediate transfer process. The removed remaining toner is sent to a waste toner container inside the process unit 1K by a waste toner conveyor and then is collected. The discharging device discharges the remaining charge of the image bearer 2K from which the remaining toner has been removed by the drum cleaning device 3K.

Similarly, toner images are formed on the image bearers 2Y, 2M, and 2C in the process units 1Y, 1M, and 1C for the colors, and the toner images in the colors are transferred to the intermediate transfer belt 16 such that the toner images are superimposed on each other.

The intermediate transfer belt 16 having the toner images in the colors superimposed on each other, travels to the secondary transfer nip between the secondary transfer roller 20 and the driving roller 18. Meanwhile, the paired registration rollers 250 nip a sheet thrust against the paired registration rollers 250 and rotate at a predetermined timing. The paired registration rollers 250 convey the sheet to the secondary transfer nip between the secondary transfer roller 20 and the driving roller 18 at a suitable timing of transferring the toner image on the intermediate transfer belt 16 due to the superimposition transfer. In this manner, the toner image on the intermediate transfer belt 16 is transferred to the sheet P sent out by the paired registration rollers 250.

The sheet P to which the toner image has been transferred, is conveyed to the fixing device 300 through the post-transfer conveyance path 33. The sheet P conveyed to the fixing device 300, is nipped by the fixing belt 310 and the pressing roller 320. Then, heating and pressing fixes the unfixed toner image to the sheet P. The sheet P to which the toner image has been fixed, is sent out from the fixing device 300 to the post-fixing conveyance path 35.

The switching member 42 is located opening in proximity to the upper end of the post-fixing conveyance path 35, as indicated with a solid line of FIG. 1A, in the timing at which the fixing device 300 sends out the sheet P. The sheet P sent out from the fixing device 300, is sent out to the sheet ejection path 36 through the post-fixing conveyance path 35. The paired ejection rollers 37 nip the sheet P sent out to the sheet ejection path 36 and drive rotationally to eject the sheet P to the ejection tray 44. Then, the single-sided printing finishes.

Next, a case where double-sided printing is performed, will be described. Similarly to the case of the single-sided printing, the fixing device 300 sends out a sheet P to the sheet ejection path 36. In the case where the double-sided printing is performed, the paired ejection rollers 37 drive rotationally to convey part of the sheet P outside the laser printer 100.

When the rear end of the sheet P passes through the sheet ejection path 36, the switching member 42 pivots on the pivot shaft 42*a* as indicated with a dotted line of FIG. 1A, to close the upper end of the post-fixing conveyance path 35. Substantially simultaneously with the close of the upper end of the post-fixing conveyance path 35, the paired ejection rollers 37 rotate in a direction reverse to the direction in which the sheet P is conveyed outside the laser printer 100, to send out the sheet P to the reverse conveyance path 41.

The sheet P sent out to the reverse conveyance path 41, reaches the paired registration rollers 250 through the paired reverse conveyance rollers 43. The paired registration rollers 250 determine an optimum timing of transferring the toner image on the intermediate transfer belt 16 to the face of the sheet P to which no toner image has been transferred (synchronization), and send out the sheet P to the secondary transfer nip.

When the sheet P passes through the secondary transfer nip, the secondary transfer roller 20 and the driving roller 18 transfer the toner image to the face of the sheet P to which no toner image has been transferred (back face). The sheet P to which the toner image has been transferred, is conveyed to the fixing device 300 through the post-transfer conveyance path 33.

The fixing device 300 nips the conveyed sheet P with the fixing belt 310 and the pressing roller 320, and fixes the unfixed toner image to the back face of the sheet P with heating and pressing. The sheet P having the toner images fixed to both of the front and back faces of the sheet P in this manner, is sent out from the fixing device 300 to the post-fixing conveyance path 35.

The switching member 42 is located opening in proximity to the upper end of the post-fixing conveyance path 35, as indicated with the solid line of FIG. 1A, in the timing at which the fixing device 300 sends out the sheet P. The sheet P sent out from the fixing device 300, is sent out to the sheet ejection path 36 through the post-fixing conveyance path 35. The paired ejection rollers 37 nip the sheet P sent out to the sheet ejection path 36 and drive rotationally to eject the sheet P to the ejection tray 44. Then, the double-sided printing finishes.

After the transfer of the toner image on the intermediate transfer belt 16 to the sheet P, the remaining toner adheres to the intermediate transfer belt 16. The belt cleaning device 21 removes the remaining toner from the intermediate transfer belt 16. The toner removed from the intermediate transfer belt 16 is conveyed to the powder container 10 by a waste toner conveyor and is collected inside the powder container 10.

Fixing Device

Figure 3A:
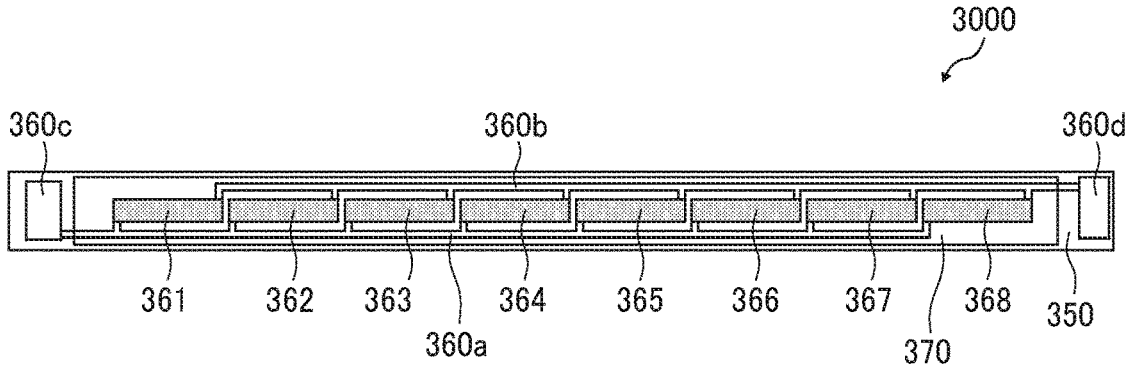
FIGS. 3A to 3C are plan views each illustrating the disposition of resistance heating elements in a planar heating body including electrodes provided at both ends.
Figure 4:
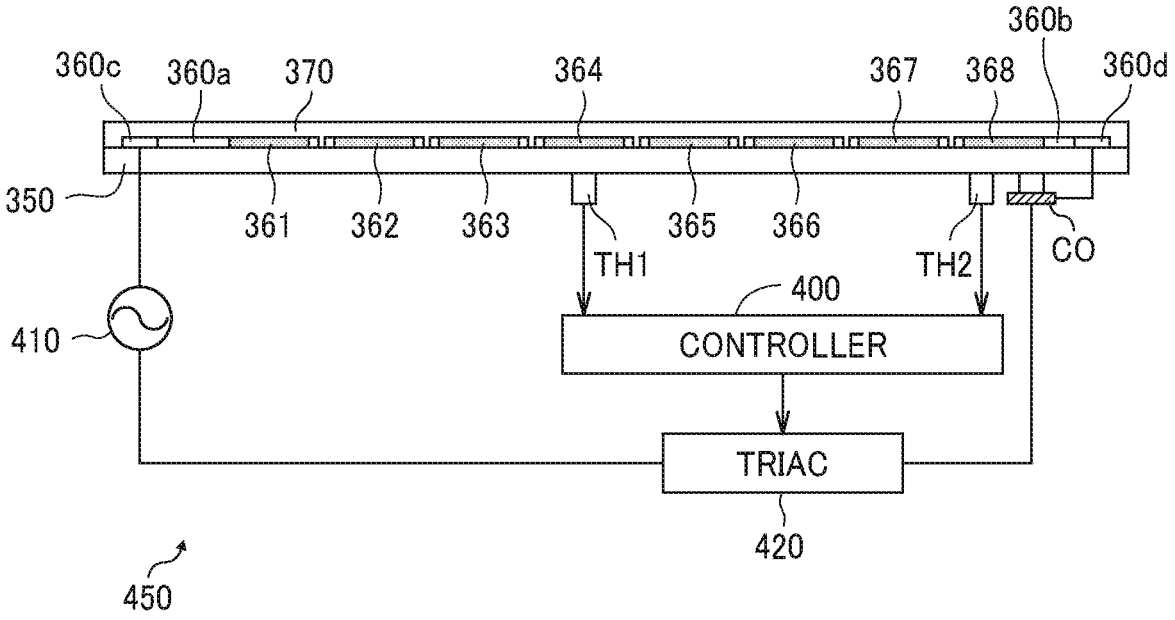

Next, the heating device and first to fourth fixing devices according to the embodiment of the present disclosure, will be further described below. The heating device 3000 according to the present embodiment is intended for heating the fixing belt 310 of the fixing device 300. As illustrated in FIGS. 3A and 4, the heating device 3000 including a planar heating body, includes: a base 350 including an elongate metallic thin member covered with an insulating material; and a heating member 360 arranged on the base 350.

The heating member 360 includes a plurality of resistance heating elements 361 to 368 disposed straight at regular intervals in the longitudinal direction of the base 350. Power lines 360*a* and 360*b* each having a small resistance value are arranged straight mutually in parallel on both sides in the lateral direction of the resistance heating elements 361 to 368. Both ends of each of the resistance heating elements 361 to 368 are connected to the power lines 360*a* and 360*b*. As illustrated in FIG. 4, a power controller is connected to electrodes 360*c* and 360*d* at respective one end portions of the power lines 360*a* and 360*b*.

The heating device 3000 according to the present embodiment includes, as a temperature detector that detects the temperature of a resistance heating element, a first temperature sensor TH1 serving as a first temperature detector and a second temperature sensor TH2 serving as a second temperature detector. The temperature sensors TH1 and TH2 can each include, for example, a thermistor. The heating device 3000 includes a power cutoff device CO serving as a power interrupter that interrupts power supply to a resistance heating element when the temperature of the resistance heating element becomes unusually high. The power cutoff device CO can include a thermostat or a fuse.

As in FIG. 4, the first temperature sensor TH1, the second temperature sensor TH2, and the power cutoff device CO are each arranged crimped with a spring to the back side of the base 350. The first temperature sensor TH1 is intended for temperature control, and the second temperature sensor TH2 is intended for safety protection. The two temperature sensors TH1 and TH2 can each include a contact thermistor having a thermal time constant of less than one second.

The first temperature sensor TH1 for temperature control is disposed in the heating region of the resistance heating element 364 (the fourth from the left end) serving as a first resistance heating element in a central region in the longitudinal direction within a minimum paper passing width. The second temperature sensor TH2 for safety protection and the power cutoff device CO are disposed in the heating region of the resistance heating element 368 (the eighth from the left end) (or the resistance heating element 361 (the first from the left end)) serving as a second resistance heating element at a farthest end portion in the longitudinal direction at which an extreme rise is more likely to occur in end-portion temperature. Note that the second temperature sensor TH2 and the power cutoff device CO can be arranged in the heating region of at least one of the other resistance heating elements 361 to 367.

The two temperature sensors TH1 and TH2 and the power cutoff device CO are disposed in the regions of the resistance heating elements 364 and 368 such that the gap between resistance heating elements at which a drop occurs in the amount of heat generation is avoided. This arrangement improves temperature controllability, and also facilitates disconnection detection in a case where disconnection occurs in part of the resistance heating elements.

Note that the first temperature sensor TH1 may be disposed in the heating region of any of the resistance heating elements 363, 365, and 366. As long as a heating region is included in an end region in the longitudinal direction, the second temperature sensor TH2 and the power cutoff device CO can be disposed in the heating region of the resistance heating element 362 that is the second from the left end or in the heating region of the resistance heating element 367 that is the seventh from the left end. Thus, the second temperature sensor TH2 and the power cutoff device CO are not necessarily disposed at a farthest end portion in the longitudinal direction.

A power control circuit serving as a power controller for power supply to the resistance heating elements 361 to 368, is illustrated below the heating device 3000 of FIG. 4. The power control circuit includes an alternating-current power source 410, a triac 420, and the power cutoff device CO. The alternating-current power source 410, the triac 420, and the power cutoff device CO are connected in series between the electrodes 360*c* and 360*d*.

Figure 5A:
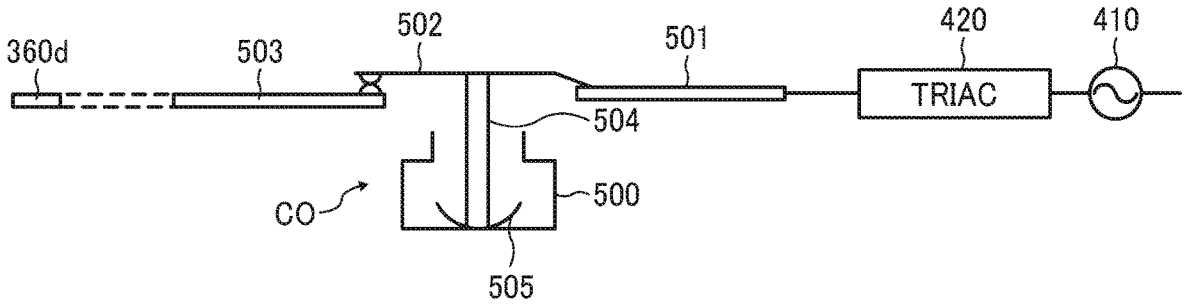
FIGS. 5A and 5B are diagrams each illustrating the configuration of a power cutoff device.
Figure 5B:
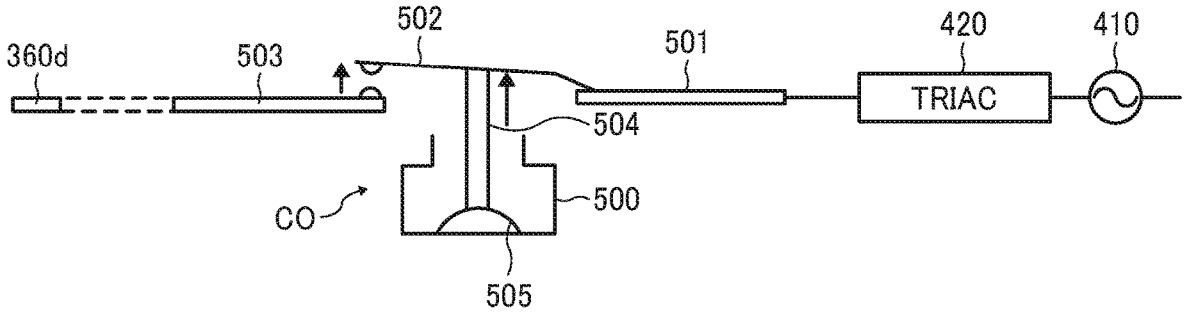

FIGS. 5A and 5B each illustrate an exemplary configuration of the power cutoff device CO. The power cutoff device CO includes a body case 500, a first terminal 501, a connector 502, a second terminal 503, an ejecting rod 504 secured on the lower face of the connector 502, and a bowl-shaped bimetal 505 disposed on the bottom of the body case 500.

The connector 502 has a base end supported by the first terminal 501. The connector 502 is biased downward due to the elasticity of the connector 502. The ejecting rod 504 couples the connector 502 and the central upper face of the bimetal 505 together. When the bimetal 505 inverts in an upward convex shape as in FIG. 5B due to a predetermined high temperature, the ejecting rod 504 pushes the connector 502 upward, so that an interruption is made between the first terminal 501 and the second terminal 503.

Temperatures $T_4$ and $T_8$ detected by the first temperature sensor TH1 and the second temperature sensor TH2 are input into a controller 400 serving as a controller. The controller 400 controls the amount of supply power to the electrodes 360*c* and 360*d* with the triac 420 such that each of the resistance heating elements 361 to 368 has a predetermined temperature, on the basis of the temperature $T_4$ acquired from the first temperature sensor TH1. As to be described later, when the second temperature sensor TH2 detects predetermined temperature information regarding the resistance heating element 368, the controller 400 interrupts the power supply from the alternating-current power source 410 to the resistance heating elements 361 to 368.

Meanwhile, when the controller 400 loses temperature control based on the temperature $T_4$ due to disconnection of the resistance heating element 364 and then the other resistance heating elements including the resistance heating element 368 at an end portion have unusual high temperature, the power cutoff device CO operates as in FIG. 5B to interrupt the power supply to the resistance heating elements 361 to 368.

The controller 400 can include a microcomputer including a central processing unit (CPU), a read-only memory (ROM), a random-access memory (RAM), and an input and output (I/O) interface. When paper passes through a fixing nip SN, heat dissipation occurs due to the passage of the paper (heat transfer to a sheet). Thus, the amount of supply power is controlled in consideration of the heat dissipation in addition to the temperature $T_4$ acquired from the first temperature sensor TH1, so that the temperature of the fixing belt 310 can be controlled to a desirable temperature.

Figure 2A:
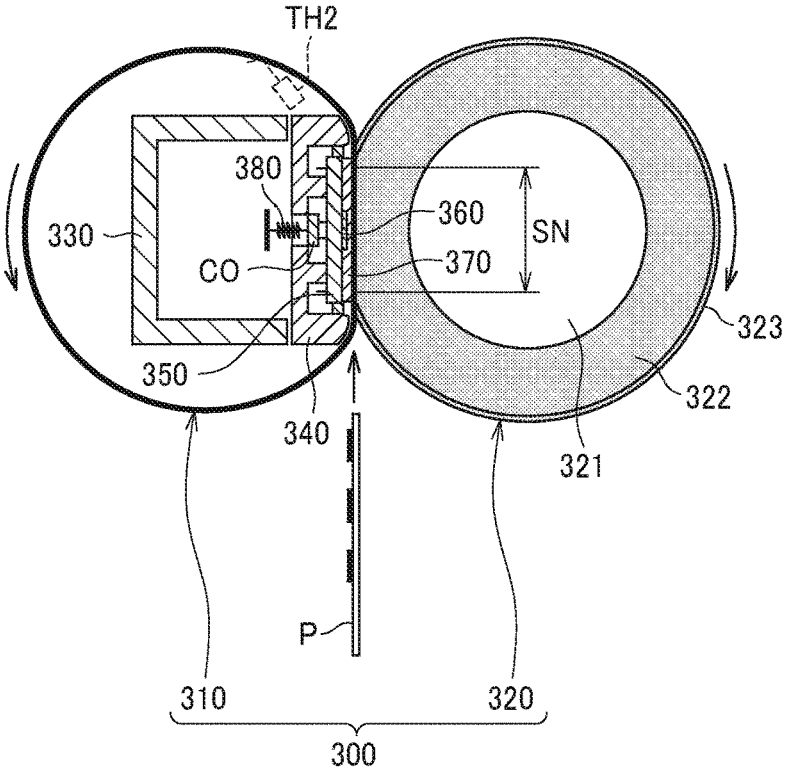
FIG. 2A is a cross-sectional view of a first fixing device according to the embodiment of the present disclosure.

As illustrated in FIG. 2A, the first fixing device includes: a thin fixing belt 310 having low heat capacity; and a pressing roller 320. The fixing belt 310 includes, for example, a tubular base made of polyimide (PI), the tubular base having an outer diameter of 25 mm and a thickness of from 40 to 120 μm.

A release layer made of a fluorine-based resin, such as a perfluoroalkoxy alkane (PFA) or polytetrafluoroethylene (PTFE), having a thickness of from 5 to 50 μm, is formed on the outermost layer of the fixing belt 310 in order to improve durability and ensure releasability. An elastic layer made of rubber having a thickness of from 50 to 500 μm may be provided between the base and the release layer.

The base of the fixing belt 310 is not limited to polyimide, and thus may be made of a thermal resistance resin, such as polyetheretherketone (PEEK), or a metal, such as nickel (Ni) or stainless steel (SUS). The inner circumferential face of the fixing belt 310 may be coated with polyimide or PTFE as a slide layer.

The pressing roller 320 having, for example, an outer diameter of 25 mm, includes a solid iron cored bar 321, an elastic layer 322 on the surface of the cored bar 321, and a release layer 323 on the outside of the elastic layer 322. The elastic layer 322 formed of silicone rubber, has, for example, a thickness of 3.5 mm. It is desirable that the release layer 323 including a fluorine resin layer having, for example, a thickness of approximately 40 μm is formed on the surface of the elastic layer 322 in order to improve releasability. The pressing roller 320 is pressed against the fixing belt 310 by a biasing means.

A stay 330 and a holder 340 are arranged axially inside the fixing belt 310. The stay 330 including a metallic channel member, has both end portions supported by the plates on both sides of the heating device 3000. The stay 330 reliably receives the pressing force of the pressing roller 320 to form the fixing nip SN stably.

The holder 340 intended for holding the base 350 of the heating device 3000, is supported by the stay 330. Favorably, the holder 340 can be formed of a thermal resistance resin having low thermal conductivity, such as a liquid crystal polymer (LCP). This arrangement reduces heat transfer to the holder 340, so that the fixing belt 310 can be heated efficiently.

The shape of the holder 340 supports each two portions in the vicinity of both end portions in the lateral direction of the base 350, in order to avoid contact with a high temperature portion of the base 350. This arrangement further reduces the amount of heat to flow into the holder 340, so that the fixing belt 310 can be heated efficiently.

The resistance heating elements 361 to 368 and the power lines 360*a* and 360*b* are covered with a thin insulating layer 370. The insulating layer 370 can be made of thermal resistance glass having, for example, a thickness of 75 μm. The insulating layer 370 insulates and protects the resistance heating elements 361 to 368 and the power lines 360*a* and 360*b*, and additionally retains slidability with the fixing belt 310 as to be described later.

Low-cost aluminum or stainless steel is favorable as the material of the base 350. The base 350 is not limited to being metallic, and thus can be made of ceramic, such as alumina or aluminum nitride, or a nonmetallic material having excellent thermal resistance and insulating properties, such as glass or mica. In order to improve the uniformity in heat of the heating device 3000 and improve image quality, the base 350 may be made of a material having high thermal conductivity, such as copper, graphite, or graphene. An alumina base having a lateral width of 8 mm, a longitudinal width of 270 mm, and a thickness of 1.0 mm is used in the present embodiment.

For example, the base 350 is coated with paste in which silver palladium (AgPd) and glass powder are compounded, by screen printing. After that, the base 350 is calcined, so that the resistance heating elements 361 to 368 can be formed. The resistance heating elements 361 to 368 each have a resistance value of 80Ω at room temperature, in the present embodiment.

The material of the resistance heating elements 361 to 368 may contain a resistance material, such as silver alloy (AgPt) or ruthenium oxide ($RuO_2$), other than the above material. The power lines 360*a* and 360*b* and the electrodes 360*c* and 360*d* can be formed with silver (Ag) or silver palladium (AgPd) by screen printing.

The insulating layer 370 side of the resistance heating elements 361 to 368 heats in contact with the fixing belt 310. Then, the fixing belt 310 rises in temperature due to heat transfer, so that an unfixed image conveyed to the fixing nip SN is heated and is fixed.

As in FIG. 3A, the resistance heating elements 361 to 368 are divided in eight sections in the longitudinal direction and electrically connected in parallel to each other. In FIG. 3A, each of the resistance heating elements 361 to 368 is formed of a rectangular planar heating element. In some embodiments, to obtain a desired output (resistance value), as illustrated in FIGS. 3G to 31 or FIGS. 3J to 3L, the resistance heating elements may be formed with a folded meandering firing pattern. In the example illustrated in FIGS. 3G to 31 or FIGS. 3J to 3L, the resistance heating elements 361 to 368 are formed with a meandering pattern of one and a half reciprocations in which a narrow wire is folded back twice.

The base 350 and the resistance heating elements 361 to 368 can heat the fixing nip SN not only through the resistance heating elements 361 to 368 but also through the base 350 by adjusting the respective materials and thermal conductivity. Therefore, as a material of the base 350, a material having high thermal conductivity such as aluminum nitride is preferable.

A gap is formed between adjacent ones of the resistance heating elements 361 to 368 to ensure insulation. If the gap is too large, fixing unevenness would occur due to a decrease in the amount of heat generated in the gap. By contrast, if the gap is too small, a short circuit would occur between the resistance heating elements 361 to 368.

Therefore, the size of the gap is preferably from 0.3 mm to 1 mm, and more preferably from 0.4 mm to 0.7 mm. As described above, heating the fixing nip SN via the base 350 can reduce fixing unevenness due to the gap between the resistance heating elements 361 to 368.

The resistance heating elements 361 to 368 can be each made of a material having a positive temperature coefficient (PTC) characteristic. The material having the PTC characteristic has a characteristic that the resistance value rises (the current I decreases and the heater output decreases) as the temperature T rises. The temperature coefficient of resistance (TCR) may be, for example, 1500 parts per million (PPM). The temperature coefficient of resistance can be stored in the memory of the controller 400.

Due to the feature, in a case where printing is performed to paper, for example, narrower than the entire width of the resistance heating elements 361 to 368 (e.g., within the width of the resistance heating elements 363 to 366), the resistance heating elements 361, 362, 367, and 368 outside the width of the paper rise in temperature because no heat is drawn by the paper. Then, the resistance values of the resistance heating elements 361, 362, 367, and 368 rise.

Because voltage across the resistance heating elements 361 to 368 is constant, the outputs of the resistance heating elements 361, 362, 367, and 368 outside the width of the sheet drop relatively, so that a rise is inhibited in end-portion temperature. In a case where the resistance heating elements 361 to 368 are electrically connected in series, in order to inhibit the resistance heating elements outside the width of paper in continuous printing, from rising in temperature, there is no method except a method of reducing the rate of printing. Electrically connecting the resistance heating elements 361 to 368 in parallel, can inhibit a rise in temperature in a no-paper passing portion, with the rate of printing retained.

Figure 3B:
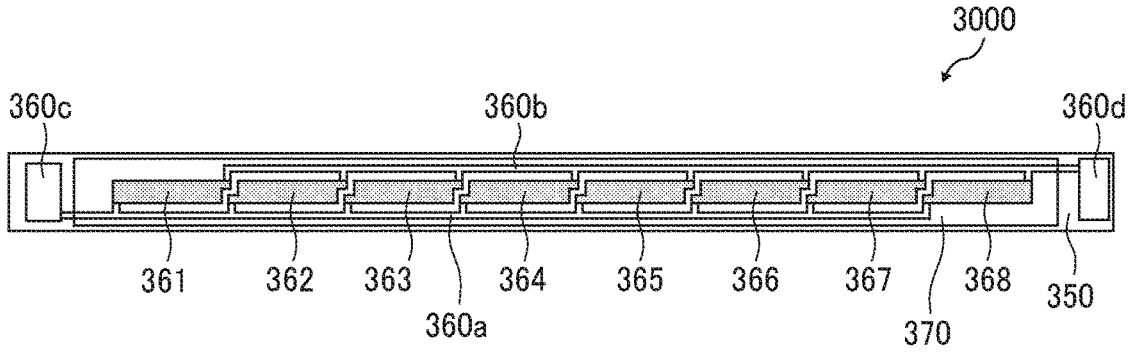
Figure 3C:
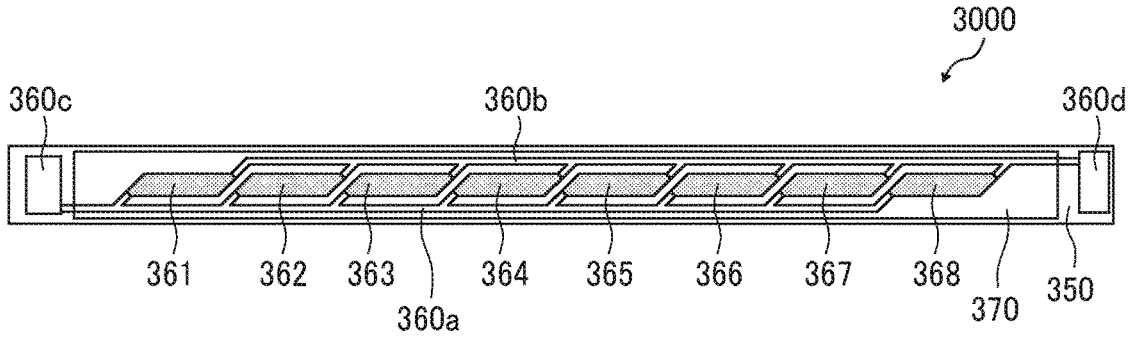
Figure 3D:
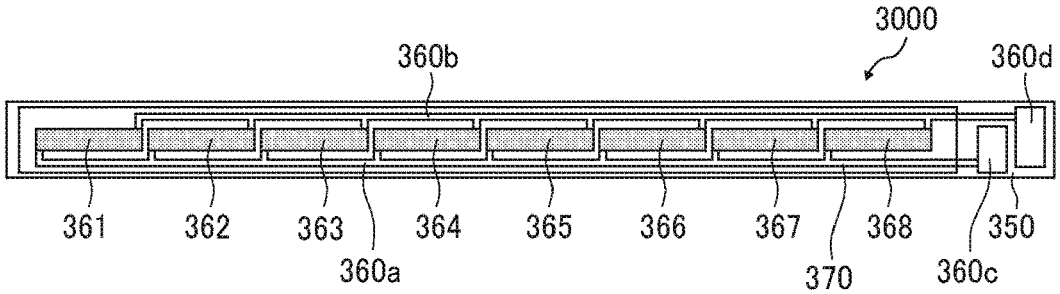
FIGS. 3D to 3F are plan views each illustrating the disposition of resistance heating elements in a planar heating body including electrodes provided at one end.
Figure 3E:
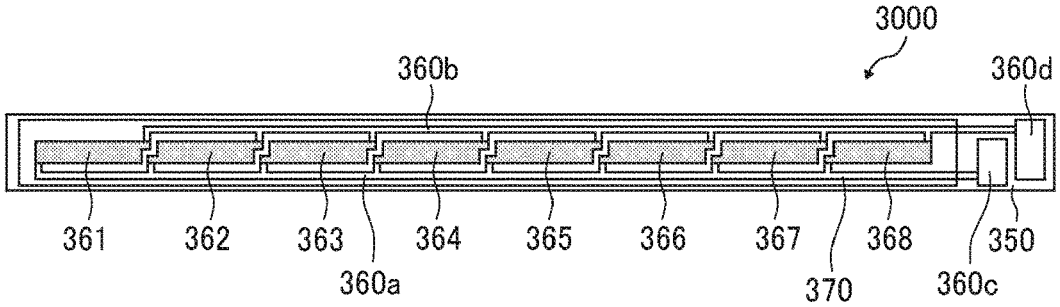
Figure 3F:
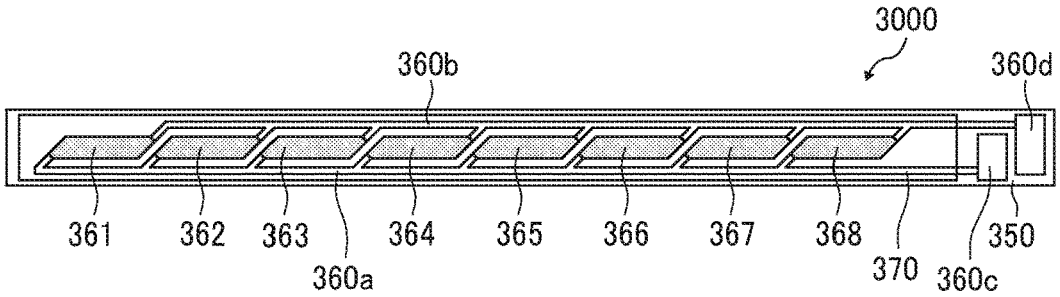
Figure 3G:
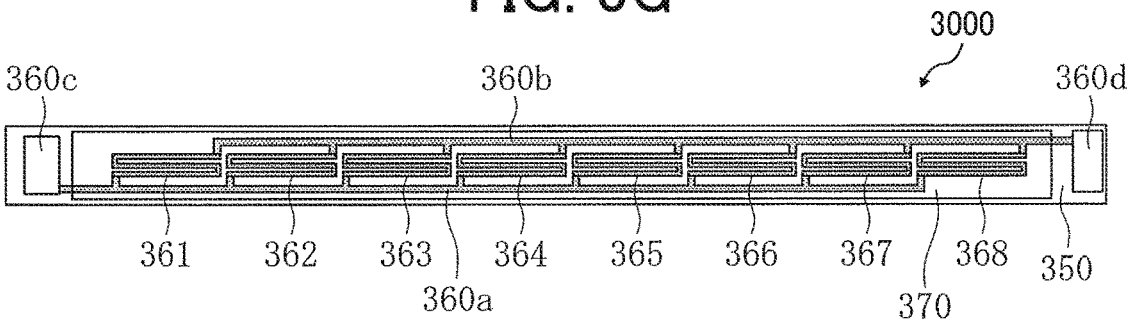
Figure 3H:
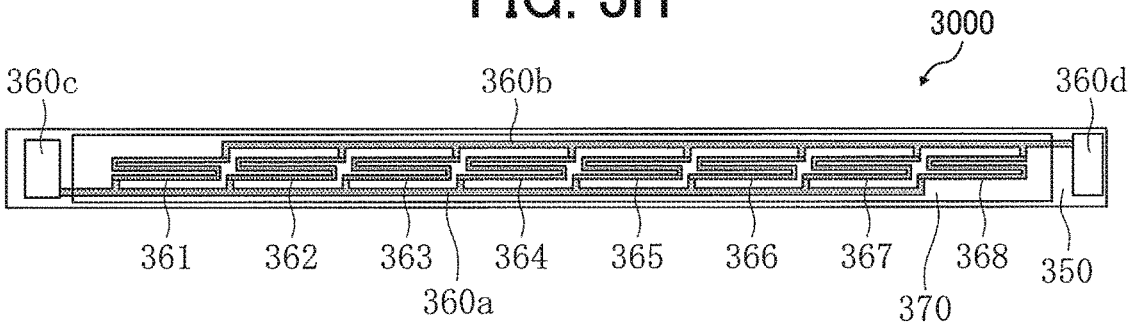
Figure 3I:
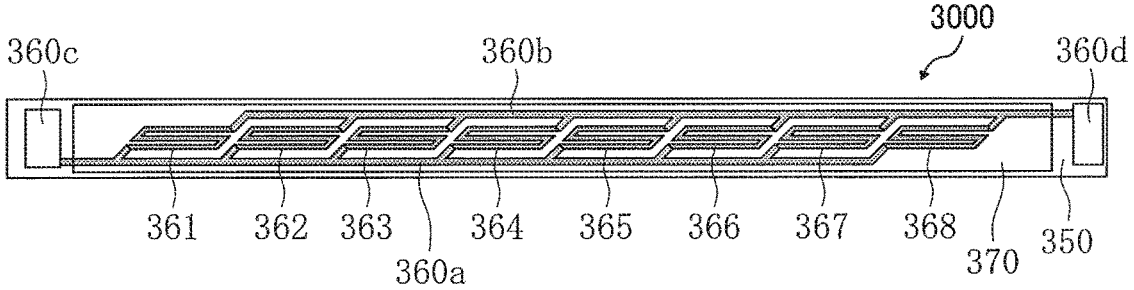
Figure 3J:
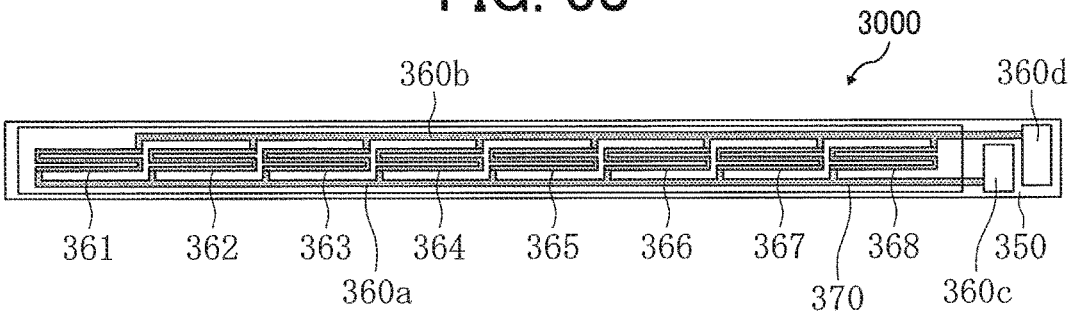
FIGS. 3J to 3L are plan views each illustrating the disposition of resistance heating elements in a meandering pattern including electrodes provided at one end.
Figure 3K:
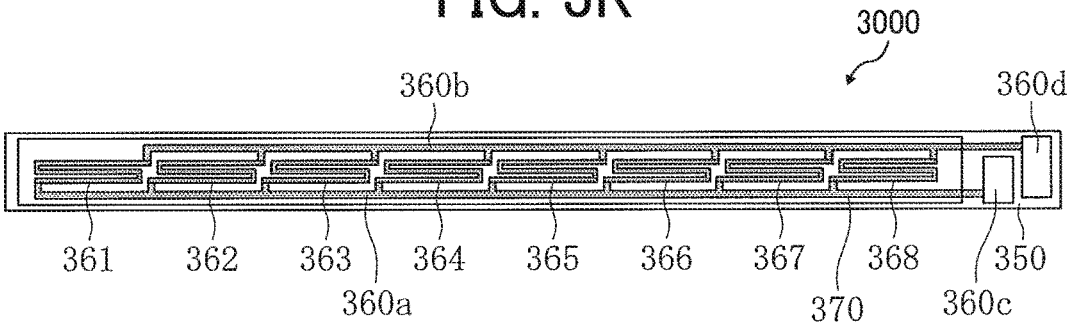
Figure 3L:
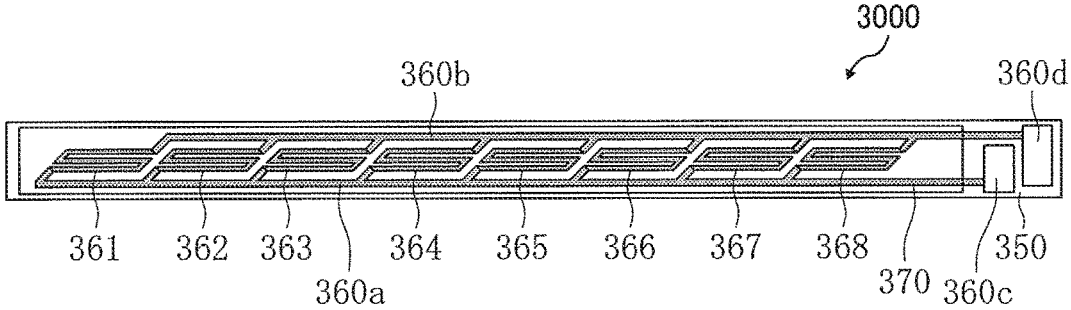

The disposition of the resistance heating elements 361 to 368 is not limited to the state of FIG. 3A. In FIG. 3A, gaps that lead in the lateral direction are present mutually between the resistance heating elements 361 to 368. In FIGS. 3B and 3C, end portions of resistance heating elements 361 to 368 overlap each other in the longitudinal direction.

In FIG. 3B, an L-shaped cut-away step is formed at each of the end portions of the resistance heating elements 361 to 368, so that the step overlaps the step of the end portion of the adjacent resistance heating element. In FIG. 3C, an oblique cut-away inclination is formed at each of the end portions of the resistance heating elements 361 to 368, so that the inclination overlaps the inclination of the end portion of the adjacent resistance heating element. Mutually overlapping the end portions of the resistance heating elements 361 to 368 in this manner, can inhibit the influence of a drop in the amount of heat generation in the gaps between the resistance heating elements.

Instead of being disposed at both ends of the resistance heating elements 361 to 368, the electrodes 360*c* and 360*d* can be disposed on one side of the resistance heating elements 361 to 368 as in FIGS. 3D to 3F or FIGS. 3J to 3L. Disposing the electrodes 360*c* and 360*d* on the one side in this manner, can achieve space conservation in the longitudinal direction.

Fixing Operation

In FIG. 2A, when a sheet P passes to the fixing nip SN in the arrow direction, the sheet P is heated between the fixing belt 310 and the pressing roller 320, so that the toner image is fixed to the sheet P. In this case, the fixing belt 310 is heated by heat from the heating member 360 while sliding on the insulating layer 370 of the heating member 360.

In a case where only the first temperature sensor TH1 is disposed for temperature control of the heating member 360 for making the fixing belt 310 have a predetermined temperature, when partial disconnection of only the resistance heating element 364 at which the first temperature sensor TH1 is disposed, interrupts power supply, the resistance heating element 364 does not rise in temperature. Thus, when the resistance heating element 364 is made to have a certain temperature by the temperature control, unnecessary power supply continues to the other normal resistance heating elements 361 to 363 and 365 to 368, so that unusual high temperature occurs. The occurrence of the unusual high temperature causes the power cutoff device CO to operate as in FIG. 5B, so that the power supply to the resistance heating elements 361 to 368 is interrupted.

However, when the resistance heating element 368 at an end portion also disconnects, the unusual high temperature cannot be prevented. Thus, the second temperature sensor TH2 is disposed in the heating region of the resistance heating element 368 at the end portion, in the present embodiment.

The second temperature sensor TH2 detects the temperature $T_8$ of the resistance heating element 368. When the temperature $T_8$ falls below a predetermined temperature $T_N$ ($T_8<T_N$) due to the disconnection, the controller 400 controls the triac 420 so as to interrupt the supply current to the electrodes 360*c* and 360*d*. Therefore, even when the power cutoff device CO is not in operation as in FIG. 5A, the power supply to the resistance heating elements 361 to 368 is reliably interrupted, so that the occurrence of the unusual high temperature can be prevented.

Here, a description is given of "disconnection state", assuming that, for example, the resistance heating element 368 of the plurality of resistance heating elements 361 to 368 is in disconnection state. In a case in which the resistance heating elements 361 to 368 are arranged in a folded meandering pattern as illustrated in FIGS. 3G to 31 or FIGS. 3J to 3L, the resistance heating element 368 is in disconnection state when a part of the pattern is broken. Alternatively, in which the resistance heating elements 361 to 368 are arranged in a rectangular pattern as illustrated in as illustrated in FIGS. 3A and 3B, the resistance heating element 368 is in disconnection state when the rectangular pattern is disconnected. In other words, the disconnection state means a state in which a path of a current flow is lost and no current flows.

In a case where the controller 400 interrupts the power supply from the alternating-current power source 410 to the resistance heating elements 361 to 368 when the second temperature sensor TH2 detects the predetermined temperature information regarding the resistance heating element 368, the "predetermined temperature information" includes not only that the temperature $T_8$ of the resistance heating element 368 satisfies $T_8<T_N$. That is the "predetermined temperature information" includes: (i) the temperature of the resistance heating element 368 is less than the predetermined temperature ($T_8<T_N$); (ii) the time until the temperature of the resistance heating element 368 reaches the predetermined temperature, is a predetermined time or more; and (iii) a variation in the temperature gradient is a predetermined value or less.

Here, $T_N$ satisfies, for example, $T_N$=100° C. in (i) the temperature of the resistance heating element 368 is less than the predetermined temperature ($T_8<T_N$). The "predetermined time or more" in (ii) indicates, for example, that the time until the temperature reaches 100° C. after the heater is switched on, is three seconds or more.

The second temperature sensor TH2 may be allowed to detect that the resistance heating element 368 has an unusual high temperature that is the predetermined temperature or more (e.g., 250° C. or more). This arrangement enables the power cutoff device CO to interrupt the power supply to the resistance heating elements 361 to 368 safely before operation at an unusual high temperature of 260° C. or more, for example.

Other Fixing Devices

Figure 2B:
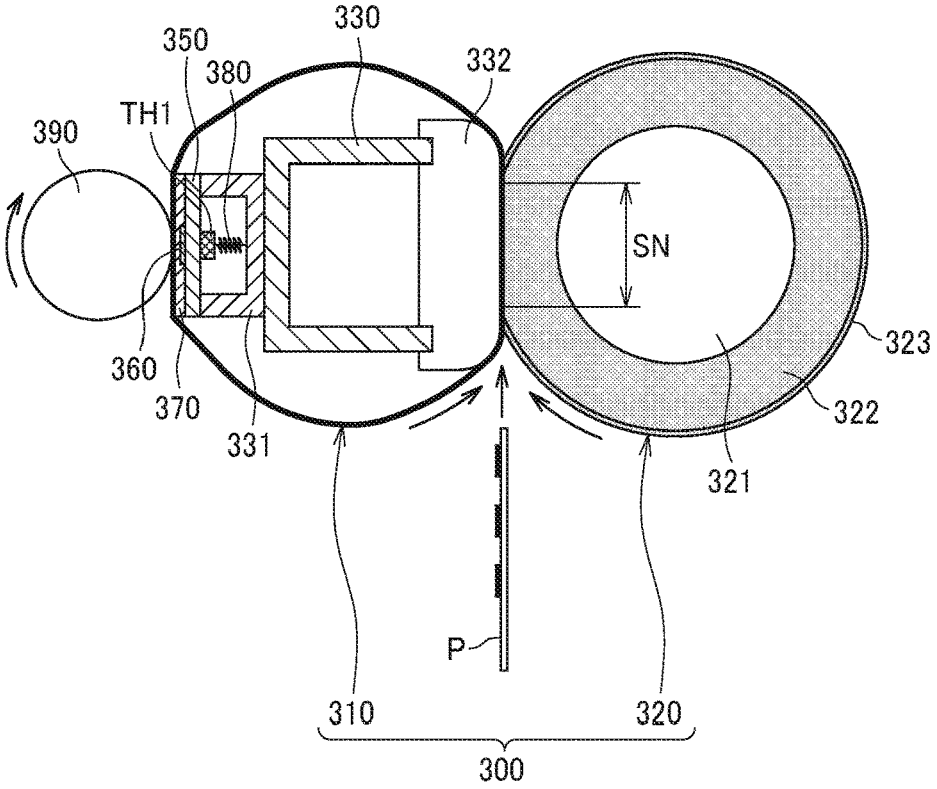
FIG. 2B is a cross-sectional view of a second fixing device according to the embodiment of the present disclosure.

The fixing device 300 is not limited to the first fixing device of FIG. 2A. The second to fourth fixing devices will be described below with reference to FIGS. 2B to 2D. As illustrated in FIG. 2B, the second fixing device including a pressure roller 390 on the opposite side of a pressing roller 320, heats a fixing belt 310 nipped between the pressure roller 390 and a heating device 3000.

The heating device 3000 described above is arranged inside the fixing belt 310. A stay 330 has an auxiliary stay 331 attached on one side and a nip formation pad 332 attached on the opposite side. The auxiliary stay 331 holds the heating device 3000. The nip formation pad 332 abuts on the pressing roller 320 through the fixing belt 310, forming a fixing nip SN.

Figure 2C:
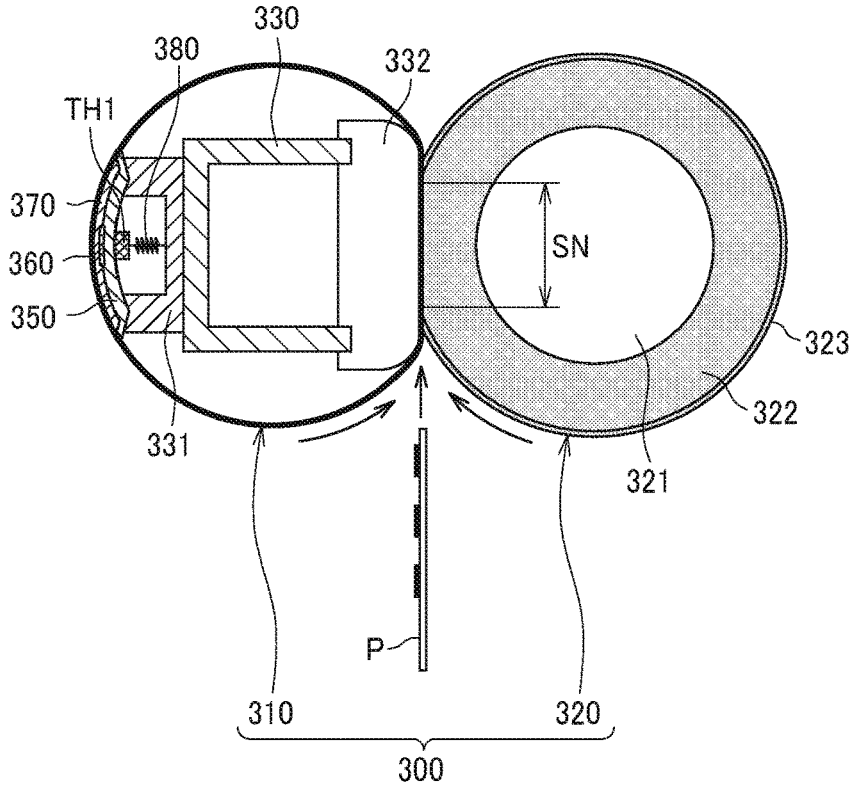
FIG. 2C is a cross-sectional view of a third fixing device according to the embodiment of the present disclosure.

As illustrated in FIG. 2C, the third fixing device includes a heating device 3000 arranged inside a fixing belt 310. Instead of the pressure roller 390 described above, the heating device 3000 has the cross sections of a base 350 and an insulating layer 370 formed in an arc shape meeting the curvature of the fixing belt 310, in order to lengthen a circumferentially contact length to the fixing belt 310. A heating member 360 is disposed at the center of the arc-shaped base 350. The third fixing device is identical to the second fixing device of FIG. 2B in terms of the others.

Figure 2D:
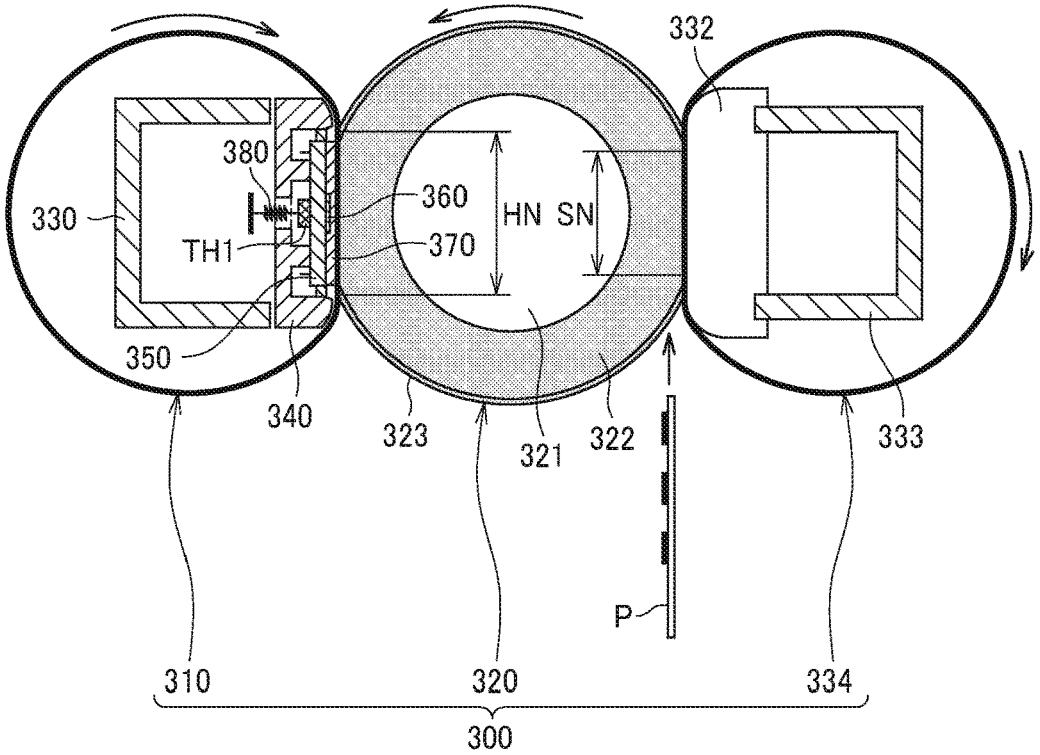
FIG. 2D is a cross-sectional view of a fourth fixing device according to the embodiment of the present disclosure.

As illustrated in FIG. 2D, the fourth fixing device includes a heating nip HN and a fixing nip SN separately. That is a nip formation pad 332 and a stay 333 including a metallic channel member are disposed on one side of a pressing roller 320 opposite to a fixing belt 310, and a pressing belt 334 is arranged circumferentially rotatably, enveloping the nip formation pad 332 and the stay 333. A sheet P passing through the fixing nip SN between the pressing belt 334 and the pressing roller 320, is subjected to heating and fixing. The fourth fixing device is identical to the first fixing device of FIG. 2A in terms of the others.

As indicated with a broken line of FIG. 2A, the second temperature sensor TH2 for safety protection may be disposed crimped by a biasing means, on the inner circumferential face of the fixing belt 310 (inner circumferential face on the downstream side of the resistance heating element 368) to be heated by the resistance heating element 368 different from the resistance heating element 364 to be detected by the first temperature sensor TH1 for temperature control. Increasing the number of resistance heating elements has difficulty in ensuring an arrangement space for a temperature sensor, but the arrangement of the second temperature sensor TH2 as the above can alleviate the difficulty of ensuring a space. In addition to the resistance heating element 368, the second temperature sensor TH2 for safety protection may be disposed in each of the heating regions of the other resistance heating elements 361 to 363 and 365 to 367, including the inner circumferential face of the fixing belt 310.

Flowchart 1

Figure 6A:
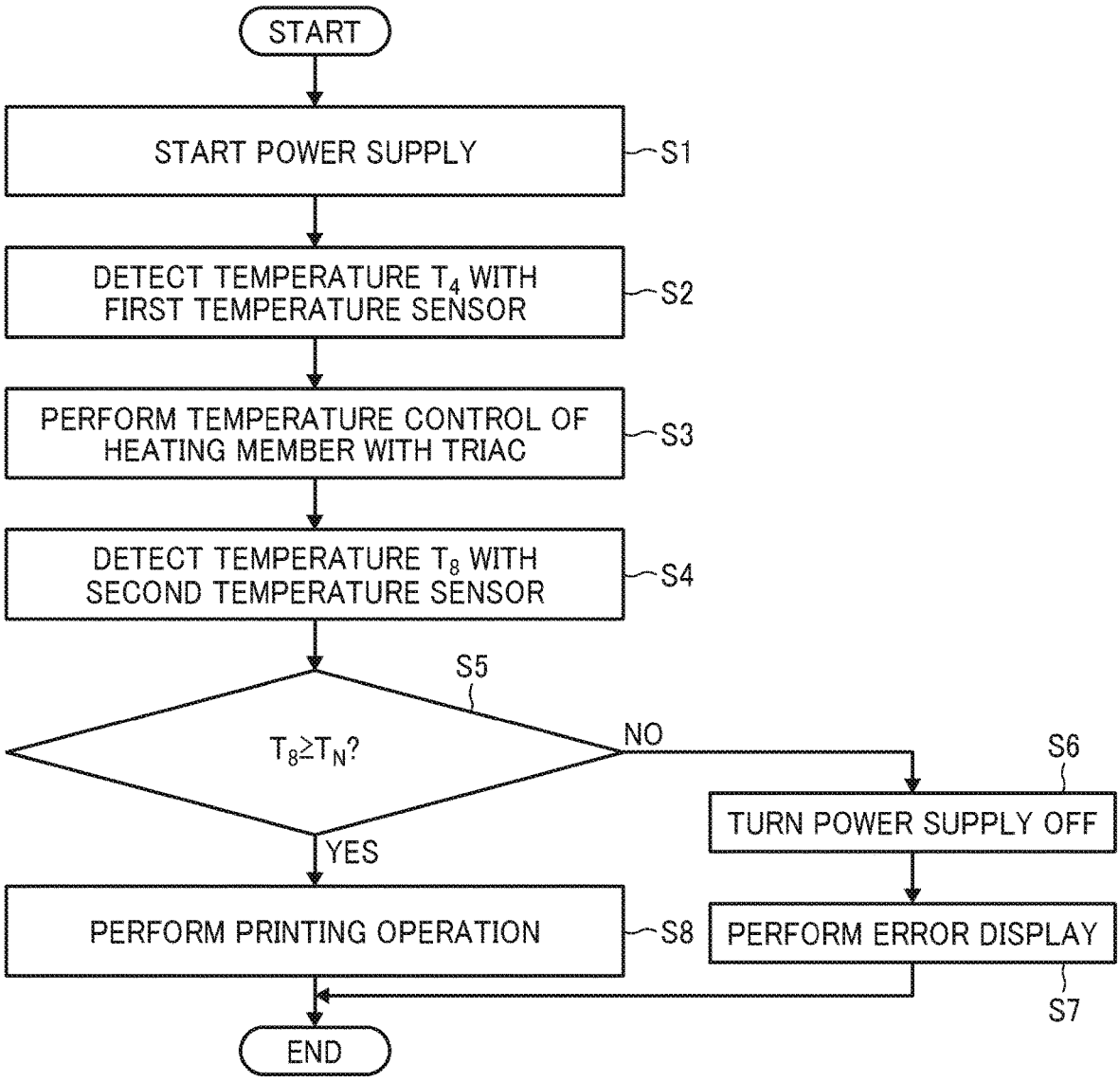
FIG. 6A is a flowchart of a control operation of the heating device.

FIG. 6A is a first flowchart of a control operation of the heating device 3000 to be performed by the controller 400 described above. In FIG. 6A, when the color laser printer 100 is instructed to perform a printing job, at step S1 the controller 400 starts power supply from the alternating-current power source 410 to the resistance heating elements 361 to 368 in the heating member 360. At step S2, the first temperature sensor TH1 detects the temperature $T_4$ of the resistance heating element 364 located in the central region of the heating member 360.

Next, at step S3, the controller 400 starts temperature control of the heating member 360. At step S4, the second temperature sensor TH2 detects the temperature $T_8$ of the resistance heating element 368. At step S5, the controller 400 determines whether the temperature $T_8$ satisfies $T_8 \geq T_N$ ($T_N$: predetermined temperature). When $T_8<T_N$ is satisfied, at S6 the controller 400 determines as occurrence of unusual low temperature (disconnection), interrupts (cuts OFF) the power supply to the heating member 360, and at S7 displays an error display on an operation panel of the color laser printer 100. When $T_8 \geq T_N$ is satisfied, the controller 400 determines as no occurrence of unusual low temperature and starts printing operation at step S8.

Flowchart 2

Figure 6B:
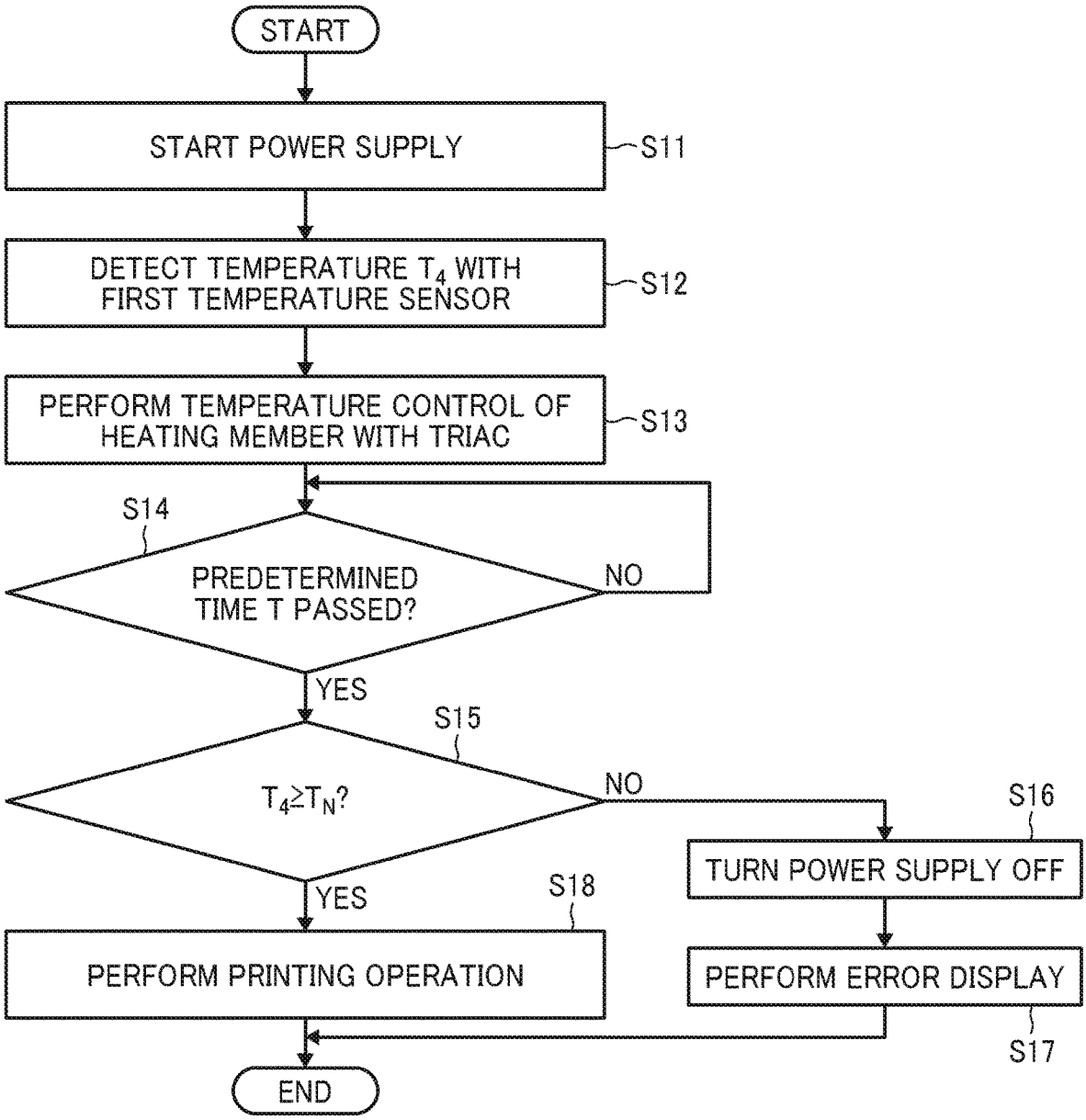
FIG. 6B is a flowchart of another control operation of the heating device.

FIG. 6B is a second flowchart of another control operation of the heating device 3000 to be performed by the controller 400 described above. Steps S11 to S13 and steps S16 to S18 in FIG. 6A are the same as steps S1 to S3 and steps S6 to S8 in FIG. 6A.

In the second flowchart, when the temperature control of the heating member 360 is started at step S13, the elapsed time of the temperature control is measured at step S14. Then, after a predetermined time T (for example, 3 seconds) has elapsed, at S15 the controller 400 determines whether the temperature $T_4$ of the first resistance heating element 364 detected by the first temperature sensor TH1 satisfies $T_4 \geq T_N$ ($T_N$: predetermined temperature).

If $T_4 < T_N$ is satisfied, the controller 400 determines as occurrence of unusual low temperature (disconnection), and at step S16 interrupts (cuts OFF) power supply to the heating member 360. At step S17, the controller 400 displays an error display on the operation panel of the color laser printer 100. When $T_4 \geq T_N$ is satisfied, the controller 400 determines as no occurrence of unusual low temperature and starts printing operation at step S18. At step S15, the controller 400 may determine whether the temperature $T_8$ of the second resistance heating element 368 detected by the second temperature sensor TH2 is $T_8 \geq T_N$ (TN: predetermined temperature).

Modification of Embodiment

The power cutoff device CO is provided according to the embodiment described above, but the power cutoff device CO of FIG. 4 can be omitted according to a modification of the present embodiment. That is the triac 420 is directly connected to the electrode 360*d* without the power cutoff device CO. Meanwhile, the controller 400 interrupts the power supply to the plurality of resistance heating elements 361 to 368 when the second temperature sensor TH2 detects the predetermined temperature information regarding the resistance heating element 368, namely, the predetermined temperature or less (e.g., 100° C. or less) or the predetermined temperature or more (e.g., 260° C. or more).

Here, the second temperature sensor TH2 typically detects, for example, a temperature of 100° C. or less when the resistance heating element 368 disconnects. However, the second temperature sensor TH2 may detect a temperature of 100° C. or less due to failure of the alternating-current power source 410 or the triac 420. Instead of detecting the predetermined temperature information regarding the resistance heating element 368 in an end region in the longitudinal direction, the second temperature sensor TH2 may detect the predetermined temperature information regarding at least one of the other resistance heating elements 361 to 367.

The present disclosure has been described above on the basis of some embodiments. However, embodiments of the present disclosure are not limited to the above-described embodiments. Needless to say, various alterations can be made in the scope of the technical idea described in the scope of the claims. For example, a heating device 3000 according to an embodiment of the present disclosure can be used for a drying device other than a fixing device. As a mode for the overlap between resistance heating elements, recess-and-protrusion or comb-shaped interdigitation can be provided other than the modes in FIGS. 3B and 3C, FIGS. 3E and 3F, FIGS. 3H and 31, and FIGS. 3K and 3L. The number of resistance heating elements may be less than eight or not less than nine. Furthermore, resistance heating elements can be disposed in a plurality of lines in the lateral direction of a base 350.

Numerous additional modifications and variations are possible in light of the above teachings. It is therefore to be understood that, within the scope of the above teachings, the present disclosure may be practiced otherwise than as specifically described herein. With some embodiments having thus been described, it will be obvious that the same may be varied in many ways. Such variations are not to be regarded as a departure from the scope of the present disclosure and appended claims, and all such modifications are intended to be included within the scope of the present disclosure and appended claims.

Each of the functions of the described embodiments may be implemented by one or more processing circuits or circuitry. Processing circuitry includes a programmed processor, as a processor includes circuitry. A processing circuit also includes devices such as an application specific integrated circuit (ASIC), digital signal processor (DSP), field programmable gate array (FPGA), and conventional circuit components arranged to perform the recited functions.

What is claimed is:

1. An image forming apparatus comprising:

a base;

a plurality of resistance heating elements arranged in a longitudinal direction of the base and electrically connected in parallel to each other;

a power control circuit configured to supply power to the plurality of resistance heating elements;

a first temperature detector configured to detect a temperature of a first resistance heating element of the plurality of resistance heating elements;

a second temperature detector configured to detect a temperature of a second resistance heating element of the plurality of resistance heating elements;

a power interrupter configured to mechanically interrupt the power supplied from the power control circuit to the plurality of resistance heating elements when the temperature of the second resistance heating element is greater than or equal to a predetermined temperature; and control circuitry configured to, control the power control circuit such that a temperature of each of the plurality of resistance heating elements becomes a first temperature, based on the temperature of the first resistance heating element detected by the first temperature detector, and interrupt the power supplied from the power control circuit to the plurality of resistance heating elements when the second temperature detector detects that the temperature of the second resistance heating element is less than or equal to a second temperature.

2. The image forming apparatus according to claim 1, wherein the first temperature detector is configured to detect the temperature of the first resistance heating element arranged in a central region in the longitudinal direction of the base.

3. The image forming apparatus according to claim 1, wherein the second temperature detector is configured to detect the temperature of the second resistance heating element arranged in an end region in the longitudinal direction of the base.

4. The image forming apparatus according to claim 1, wherein each of the plurality of resistance heating elements includes a resistance material having a positive temperature coefficient characteristic.

5. The image forming apparatus according to claim 1, wherein the plurality of resistance heating elements overlaps each other in the longitudinal direction of the base.

6. The image forming apparatus according to claim 1, further comprising:

a fixing device including, a pressing rotator;

a nip former configured to form a fixing nip between the nip former and the pressing rotator to fix a developer on a recording medium passing through the fixing nip;

a belt member having a tubular shape; and the plurality of resistance heating elements [[,]] configured to heat the belt member.

7. The image forming apparatus according to claim 6, wherein the plurality of resistance heating elements is disposed at an inner side of the belt member, and the belt member is to rotate around the plurality of resistance heating elements while being nipped with the nip former and the pressing rotator in the fixing nip.

8. The image forming apparatus according to claim 6, wherein the heat of the belt member is transferred to the fixing nip via the pressing rotator.

9. The image forming apparatus according to claim 6, wherein the second temperature detector of the plurality of resistance heating elements contacts an inner peripheral surface of the belt member at a position downstream, in a direction of conveyance of the recording medium, from one of the plurality of resistance heating elements disposed in an end region of the base in the longitudinal direction.

10. The image forming apparatus according to claim 6, further comprising:

an image forming device configured to form an image with the developer; and a recording-medium feeder configured to feed the recording medium to the image forming device, wherein the fixing device is configured to fix the image on the recording medium.

11. The image forming apparatus according to claim 1, wherein the first temperature detector is configured to generate a first temperature signal indicating the temperature of the first resistance heating element, the second temperature detector is configured to generate a second temperature signal indicating the temperature of the second resistance heating element, and the control circuitry is configured to, control the power control circuit such that the temperature of each of the plurality of resistance heating elements becomes the first temperature, based on the first temperature signal from the first temperature detector, and interrupt the power supplied from the power control circuit to the plurality of resistance heating elements when the second temperature signal from the second temperature detector indicates that the temperature of the second resistance heating element is less than or equal to the second temperature.

12. An image forming apparatus comprising:

a base;

a plurality of resistance heating elements arranged in a longitudinal direction of the base and electrically connected in parallel to each other;

a first temperature detector configured to detect a temperature of a first resistance heating element of the plurality of resistance heating elements;

a second temperature detector configured to detect a temperature of a second resistance heating element of the plurality of resistance heating elements; and a power interrupter configured to interrupt a power supplied to the plurality of resistance heating elements when the temperature of the second resistance heating element is greater than or equal to a predetermined temperature, wherein the power supplied to one of the plurality of resistance heating elements different from the second resistance heating element is interrupted in response to disconnection of the second resistance heating element after a start of power supply to the one of the plurality of resistance heating elements different from the second resistance heating element, and the power supplied to the plurality of resistance heating elements is interrupted when the second temperature detector indicates that the temperature of the second resistance heating element is less than or equal to a set temperature.

13. The image forming apparatus according to claim 12, wherein the first temperature detector is configured to detect the temperature of the first resistance heating element arranged in a central region in the longitudinal direction of the base.

14. The image forming apparatus according to claim 12, wherein the second temperature detector is configured to detect the temperature of the second resistance heating element arranged in an end region in the longitudinal direction of the base.

15. The image forming apparatus according to claim 12, wherein each of the plurality of resistance heating elements includes a resistance material having a positive temperature coefficient characteristic.

16. The image forming apparatus according to claim 12, wherein the plurality of resistance heating elements overlaps each other in the longitudinal direction of the base.

17. An image forming apparatus comprising:

a heating device including, a base, a plurality of resistance heating elements arranged in a longitudinal direction of the base and electrically connected in parallel to each other, a first temperature detector opposite a first resistance heating element of the plurality of resistance heating elements, and a second temperature detector opposite a second resistance heating element of the plurality of resistance heating elements;

a power control circuit configured to supply a power to the plurality of resistance heating elements; and control circuitry configured to, control the power control circuit such that a temperature detected by the first temperature detector approaches a first temperature, and interrupt the power supplied from the power control circuit to the plurality of resistance heating elements when a temperature detected by the second temperature detector is less than or equal to a second temperature in a state where a temperature of at least one of the plurality of resistance heating elements other than the second resistance heating element is greater than or equal to a predetermined temperature.

18. The image forming apparatus of claim 17, further comprising:

a power interrupter configured to interrupt the power supplied from the power control circuit to the plurality of resistance heating elements in response to a temperature of the second resistance heating element being greater than or equal to the predetermined temperature.

19. The image forming apparatus according to claim 17, wherein the image forming apparatus is an electrophotographic apparatus.

20. The image forming apparatus according to claim 17, wherein the image forming apparatus is an inkjet drying apparatus.

21. The image forming apparatus according to claim 17, wherein the first temperature detector is configured to detect the temperature of the first resistance heating element arranged in a central region in the longitudinal direction of the base.

22. The image forming apparatus according to claim 17, wherein the second temperature detector is configured to detect the temperature of the second resistance heating element arranged in an end region in the longitudinal direction of the base.

23. The image forming apparatus according to claim 17, wherein each of the plurality of resistance heating elements includes a resistance material having a positive temperature coefficient characteristic.

24. The image forming apparatus according to claim 17, wherein the plurality of resistance heating elements overlaps each other in the longitudinal direction of the base.

25. The image forming apparatus according to claim 17, further comprising:

a fixing device including, a pressing rotator;

a nip former configured to form a fixing nip between the nip former and the pressing rotator to fix a developer on a recording medium passing through the fixing nip;

a belt member having a tubular shape; and the plurality of resistance heating elements, configured to heat the belt member.

26. The image forming apparatus according to claim 25, wherein the plurality of resistance heating elements is disposed at an inner side of the belt member, and the belt member is to rotate around the plurality of resistance heating elements while being nipped with the nip former and the pressing rotator in the fixing nip.

27. The image forming apparatus according to claim 25, wherein the heat of the belt member is transferred to the fixing nip via the pressing rotator.

28. The image forming apparatus according to claim 25, wherein the second temperature detector of the plurality of resistance heating elements contacts an inner peripheral surface of the belt member at a position downstream, in a direction of conveyance of the recording medium, from one of the plurality of resistance heating elements disposed in an end region of the base in the longitudinal direction.

29. The image forming apparatus according to claim 25, further comprising:

an image forming device configured to form an image with the developer; and a recording-medium feeder configured to feed the recording medium to the image forming device, wherein the fixing device is configured to fix the image on the recording medium.

30. The image forming apparatus according to claim 17, wherein the first temperature detector is configured to generate a first temperature signal indicating the temperature of the first resistance heating element, the second temperature detector is configured to generate a second temperature signal indicating the temperature of the second resistance heating element, and the control circuitry is configured to, control the power control circuit such that the temperature of each of the plurality of resistance heating elements becomes the first temperature, based on the first temperature signal from the first temperature detector, and interrupt the power supplied from the power control circuit to the plurality of resistance heating elements when the second temperature signal from the second temperature detector indicates that the temperature of the second resistance heating element is less than or equal to the second temperature.

31. An image forming apparatus, comprising:

a heater including, a base;

a plurality of resistance heating elements arranged in a longitudinal direction of the base and electrically connected in parallel to each other;

a first temperature detector opposite a first resistance heating element of the plurality of resistance heating elements; and a second temperature detector opposite a second resistance heating element of the plurality of resistance heating elements, wherein a power supplied to at least one of the plurality of resistance heating elements different from the second resistance heating element is interrupted in a state of disconnection of the second resistance heating element after a start of power supply to the at least one of the plurality of resistance heating elements different from the second resistance heating element.

32. The image forming apparatus according to claim 31, wherein the power supplied to the plurality of resistance heating elements is interrupted when a temperature detected by the second temperature detector is less than or equal to a set temperature.

33. The image forming apparatus according to claim 31, wherein the image forming apparatus is an electrophotographic apparatus.

34. The image forming apparatus according to claim 31, wherein the image forming apparatus is an inkjet drying apparatus.

35. The image forming apparatus according to claim 31, wherein the first temperature detector is configured to detect a temperature of the first resistance heating element arranged in a central region in the longitudinal direction of the base.

36. The image forming apparatus according to claim 31, wherein the second temperature detector is configured to detect a temperature of the second resistance heating element arranged in an end region in the longitudinal direction of the base.

37. The image forming apparatus according to claim 31, wherein each of the plurality of resistance heating elements includes a resistance material having a positive temperature coefficient characteristic.

38. The image forming apparatus according to claim 31, wherein the plurality of resistance heating elements overlaps each other in the longitudinal direction of the base.

* * * * *